United States Patent [19]

Matsui et al.

[11] Patent Number: 5,027,039

[45] Date of Patent: Jun. 25, 1991

[54] ELECTRONIC FLASH APPARATUS

[75] Inventors: Hideki Matsui, Yokohama; Nobuyoshi Hagiuda, Kawasaki, both of Japan

[73] Assignee: Nikon Corporation, Tokyo, Japan

[21] Appl. No.: 469,933

[22] Filed: Jan. 24, 1990

[30] Foreign Application Priority Data

Jan. 30, 1989 [JP] Japan ..... 1-21840

[51] Int. Cl.[5] ..... H05B 37/00

[52] U.S. Cl. ..... 315/241 P; 354/417

[58] Field of Search ..... 315/241 P, 226; 354/415, 417

[56] References Cited

U.S. PATENT DOCUMENTS

| | | | |
|---|---|---|---|
| 4,085,353 | 4/1978 | Adams | 345/241 P |
| 4,591,762 | 5/1986 | Nakamura | 315/241 P |
| 4,608,522 | 8/1986 | Yuasa | 315/241 P |

*Primary Examiner*—Eugene R. LaRoche

*Assistant Examiner*—Amir Zarabian

*Attorney, Agent, or Firm*—Shapiro and Shapiro

[57] ABSTRACT

In an electronic flash apparatus, a flash preparation signal is sent from a signal generating means to a first switching device at a first timing preceding the flash emission, the first switching device is rendered conductive to start a resonant oscillation in a resonance circuit, thereby charging a trigger capacitor. If the flash preparation signal is terminated in the course of the resonance action, the first switching device is rendered non-conductive at a timing when the junction between the cathode of the flash discharge tube and the first switching device assumes a negative potential by the resonance action. Then, when a flash start signal is sent from the signal generating means to a second switching device at a second timing which is at least later than the above-mentioned timing, a trigger circuit is activated to supply the flash discharge tube with a trigger voltage, thereby starting the flash emission.

5 Claims, 4 Drawing Sheets

ELECTRONIC FLASH APPARATUS

BACKGROUND OF THE INVENTION

1. Field of the Invention

The present invention relates to an electronic flash apparatus capable of high-speed consecutive flash emissions.

2. Related Background Art

FIG. 7 shows a conventional example of the electronic flash apparatus. Between a power supply line $l_{11}$ and a ground line $l_{12}$ there are serially connected a flash discharge tube Xe such as a xenon discharge tube and a main thyristor SCR11, and the trigger electrode and the cathode of the flash discharge tube Xe are connected to the secondary coil of a trigger transformer T, which constitutes a trigger circuit TC in combination with a trigger capacitor C11. To said trigger circuit TC there is connected a trigger thyristor SCR12 which is rendered conductive by a trigger signal supplied to a gate thereof through a line $l_{13}$. Also there is provided a known current diverting circuit including a current diverting capacitor C12 and a current diverting thyristor SCR13.

When the trigger thyristor SCR12 is rendered conductive in a state in which an unrepresented main capacitor, a trigger capacitor C11 and a current diverting capacitor C12 are charged, a high voltage is generated in the secondary coil of the trigger transformer T and is applied between the trigger electrode and the cathode of the flash discharge tube Xe, whereby the flash discharge tube Xe starts discharge and light emission by the electric charge in said unrepresented main capacitor, but sufficient light emission is not obtained at this point since the main thyristor SCR11 is still non-conductive.

In this state the potential of the junction point of anode of the main thyristor SCR11, cathode of the flash discharge tube Xe, resistor R11 and current-diverting capacitor C12 (hereinafter called point K) is elevated. The potential increase of the point K results in a potential increase of the other terminal of the current-diverting capacitor C12 (hereinafter called point L), and further in a potential increase at the other terminal of a capacitor C13, namely the junction between the capacitor C13 and a resistor R12, whereby said potential increase is transmitted through said resistor R12 and a line $l_{14}$ to the gate of the main thyristor SCR11. The main thyristor SCR11 is thus rendered conductive, and the flash discharge tube Xe starts main light emission.

At the same time, an unrepresented light metering system starts light metering, and a flash stop signal is released to a line $l_{15}$ when a predetermined amount of flash is reached. In response a current-diverting thyristor SCR13 is rendered conductive, thus inversely biasing the main thyristor SCR11 and terminating the flash emission of the flash discharge tube Xe in the known manner.

The amount of each light emission is determined by the time from the supply of a flash start signal to the line $l_{13}$ to the supply of the flash stop signal to the line $l_{15}$. Thus the amount of light emitted from the flash discharge tube Xe can be decreased or increased by extending or shortening said time.

Consecutive flash emissions with limited amount of light each time can be obtained by reducing the interval of flash start signals, but said interval cannot be shortened excessively because of the following reason.

The trigger capacitor C11 constituting the trigger circuit TC, has a relatively large charging resistor R13 and cannot therefore be charged in time if the interval of flash emissions is reduced. Thus, even when the thyristor SCR12 becomes conductive, the trigger voltage cannot be applied to the flash discharge tube Xe since the trigger capacitor C11 is not charged. The resistance of the charging resistor R13 for the trigger capacitor C11 has to be decreased in order to reduce the interval of the flash emissions, but said resistance has a lower limit in relation to the holding current of the trigger thyristor SCR12. Consequently such conventional circuitry can control the amount of light emission each time, but cannot achieve consecutive flash emissions at a high speed.

SUMMARY OF THE INVENTION

In consideration of the foregoing, the object of the present invention is to achieve control of amount of light emission each time and control of high-speed consecutive flash emissions with a circuit structure comparable to the conventional one.

The above-mentioned object can be attained according to the present invention by an embodiment shown in FIG. 1A, which will be explained in the following.

In said embodiment there are provided a flash discharge tube Xe provided between a power supply line $l_1$ and a ground line $l_2$; a main capacitor C1 to be charged by a power source for accumulating an electric charge for causing flash emission from said flash discharge tube Xe; a trigger circuit TC including at least a trigger capacitor C2 and a trigger transformer T for supplying the flash discharge tube Xe with a trigger voltage; a first switching device SCR1 serially connected with the flash discharge tube Xe, passing the current only in a direction from the power supply line $l_1$ to the ground line $l_2$ when rendered conductive by a flash preparation signal but rendered non-conductive when inversely biased after the termination of the flash preparation signal; and a second switching device for activating the trigger circuit TC in response to a flash start signal. There are further provided a flash amount control capacitor C3 connected to the junction between the flash discharge tube Xe and the first switching device SCR1 and serving to limit the amount of light emission of the flash discharge tube Xe when charged by the flash current; a coil L2 constituting an LC resonance circuit LC with said controlling capacitor C3 and so connected that said resonance circuit LC forms a closed loop with the first switching device SCR1; signal generating means FCC for generating the flash preparation signal at a first timing; and a flash start signal control circuit FSC for generating the flash start signal at a later second timing, wherein the resonance circuit LC and the trigger capacitor C2 are so connected that said trigger capacitor C2 is charged during the resonant function of said resonance circuit LC. In addition, said second timing is selected after the inverse biasing of the first switching device SCR1 by a negative potential generated between said first switching device SCR1 and the flash discharge tube Xe, as the result of the resonant action of the resonance circuit LC caused the conductive state of the first switching device SCR1 in response to the flash preparation signal.

When the flash preparation signal is sent from the signal generating means FCC to the first switching device SCR1 at the first timing preceding the flash emission, the first switching device SCR1 is rendered conductive to start the resonant oscillation in the resonance circuit LC, thereby charging the trigger capacitor C2. If the flash preparation signal is terminated in the course of said resonance action, the first switching device SCR1 is rendered non-conductive at a timing when the junction between the cathode of the flash discharge tube Xe and the first switching device SCR1 assumes a negative potential by said resonance action. Then, when the flash start signal is sent from the signal generating means FSC to the second switching device SCR2 at the second timing which is at least later than the above-mentioned timing, the trigger circuit TC is activated to supply the flash discharge tube Xe with the trigger voltage, thereby starting the flash emission.

As the trigger capacitor C2 is charged prior to the flash emission, there can be obtained consecutive flash emissions repeated at a high speed. Also a full flash emission is obtained if the flash preparation is continued until the end of LC resonance.

In the foregoing description, there has been cited the drawing of an embodiment of the present invention, but it is by no means limited to such embodiment.

BRIEF DESCRIPTION OF THE DRAWINGS

FIGS. 1A to 3 illustrate an embodiment of the present invention, wherein FIG. 1A is a circuit diagram of the entire apparatus; FIG. 2 is a timing chart of consecutive flash emissions; and FIG. 3 is a timing chart of a full flash emission;

FIGS. 5 and 6 illustrate another embodiment, wherein FIG. 5 is a partial circuit diagram; and FIG. 6 is a timing chart thereof.

DESCRIPTION OF THE PREFERRED EMBODIMENTS

Figure 1A:
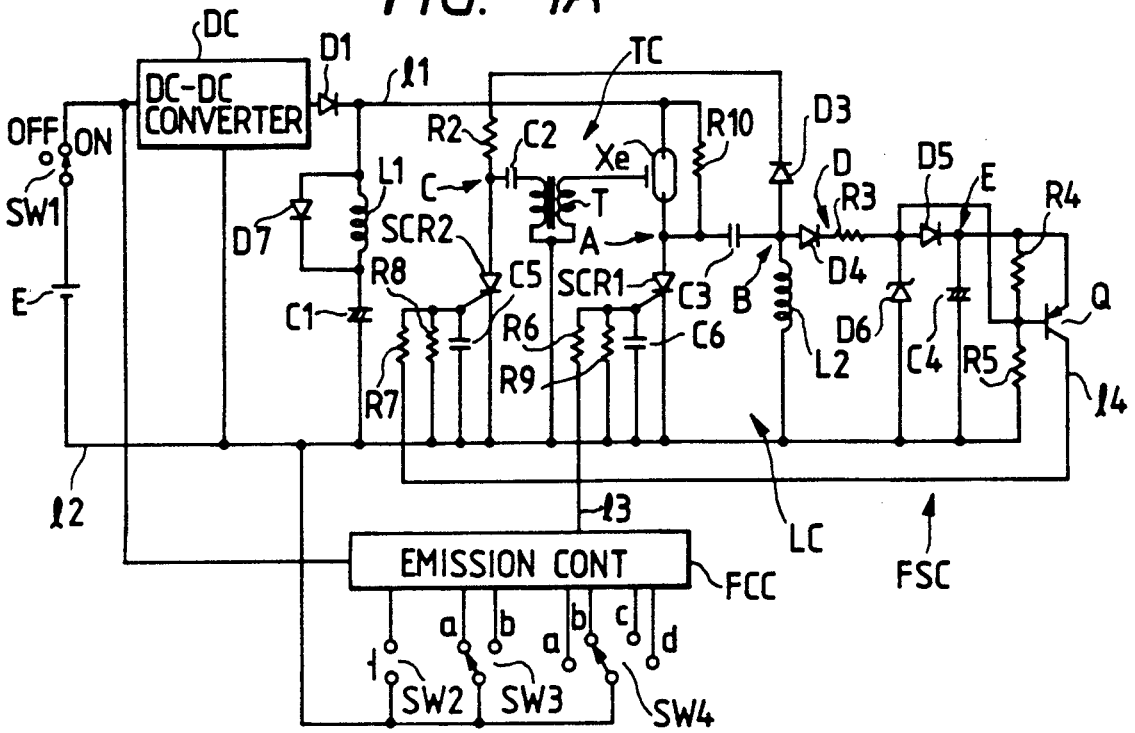

Referring to FIG. 1A, there are shown a lower voltage power source E for the electronic flash apparatus, composed for example of a battery; a power switch SW1; and a DC-DC converter DC. When the power switch SW1 is closed, the DC-DC converter DC starts the voltage elevating operation, and the high-voltage output thereof is supplied through a diode D1 and a coil L1 to a main capacitor C1 thereby accumulating therein the energy for flash emission.

Between a power supply line $l_1$ and a ground line $l_2$ there is connected a flash discharge tube Xe in series with a main thyristor SCR1 serving as the one-directional switching device. The gate of said main thyristor SCR1 is connected, through a resistor R6 and a line $l_3$, to a flash control circuit FCC from which a flash preparation signal is transmitted.

A trigger circuit TC is composed of a resistor R2, a trigger capacitor C2 and a trigger transformer T, of which secondary coil is connected, at both ends thereof, to the trigger electrode of the flash discharge tube Xe and the ground line $l_2$. The trigger capacitor C2 is charged by the function of an LC resonance circuit LC to be explained later, prior to the flash emission.

To the junction of the cathode of the flash discharge tube Xe and the main thyristor SCR1 there is connected a capacitor C3 for controlling the amount of flash emission, and an LC resonance circuit LC is formed with a coil L2 connected between the other end of said capacitor C3 and the ground line $l_3$. To the junction between the capacitor C3 and the coil L2, there is connected the resistor R2 of the trigger circuit T through a diode D3. Said junction is also connected to a flash start signal control circuit FSC through a diode D4.

Said flash start signal control circuit FSC is composed of diodes D4, D5, resistors R3–R5, a Zenar diode D6, a capacitor C4, and a PNP transistor Q. The base of said transistor Q is connected to the junction between the resistor R3 and the diode D5, while the emitter is connected to the cathode of the diode D5, and the collector is connected, through a line $l_4$ and a resistor R7, to the gate of a trigger circuit activating thyristor SCR2.

The flash control circuit FCC is provided for example in the camera body for selecting the mode of flash emission, the number of flash emissions etc., and is connected to switches SW2–SW4. SW2 is a flash start switch for starting the flash emission. SW3 is a flash time control switch for determining the duration of flash emission of the flash discharge tube Xe. In the present embodiment, a position "a" provides short pulsed emissions from the flash discharge tube Xe, while a position "b" provides a longer full flash emission. SW4 is a flash number control switch for determining the number of flash emissions for each closing of the flash start switch SW2. In the present embodiment, a position "a" provides a single flash. Positions "b", "c" and "d" respectively provide 2, 4 or 8 consecutive flash emissions.

Figure 1B:
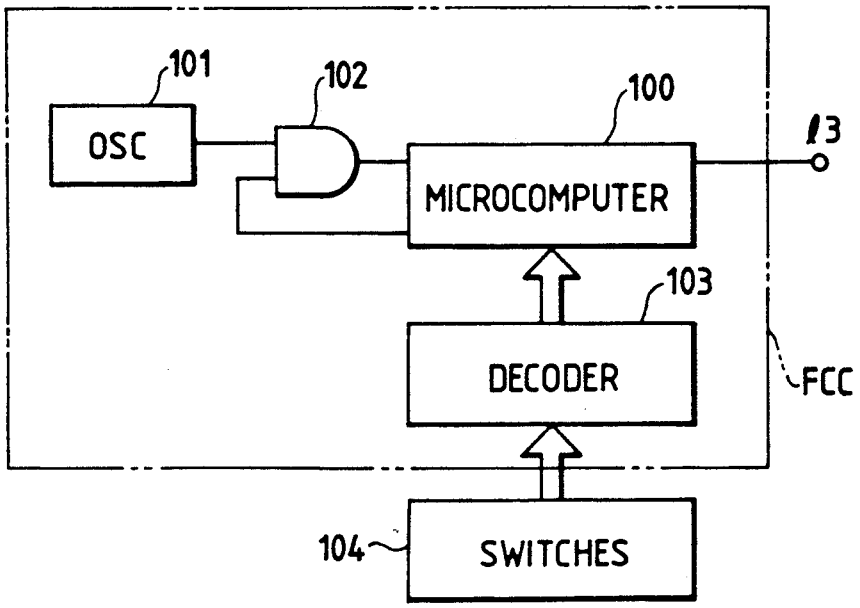
FIG. 1B is a block diagram of details of the circuit shown in FIG. 1A.

FIG. 1B shows the structure of the flash control circuit FCC, in which switches 104 correspond to those SW2–SW4 shown in FIG. 1A. When the switch SW3 is positioned at "a", a microcomputer 100 sets the number of flash emission, selected by the switch SW4, in an internal counter. A oscillator 101 releases pulses at a predetermined frequency through an AND gate 102, which is closed when the internal counter of the microcomputer 100 counts the present number of pulses from the oscillator 101. When the switch SW3 is positioned at "b", the microcomputer 100 maintains the signal of a line $l_3$ at the high level for a predetermined period.

In FIG. 1B there are further shown resistors R8–R10, capacitors C5, C6 and a diode D7.

The above-explained apparatus functions in the following manner.

In response to the closing of the power switch SW1, the DC-DC converter DC is activated, whereby the main capacitor C1 is charged through the rectifying diode D1, diode D7 and coil L1. At the same time the flash amount controlling capacitor C3 is charged through the resistor R10 and coil L2.

Figure 2:
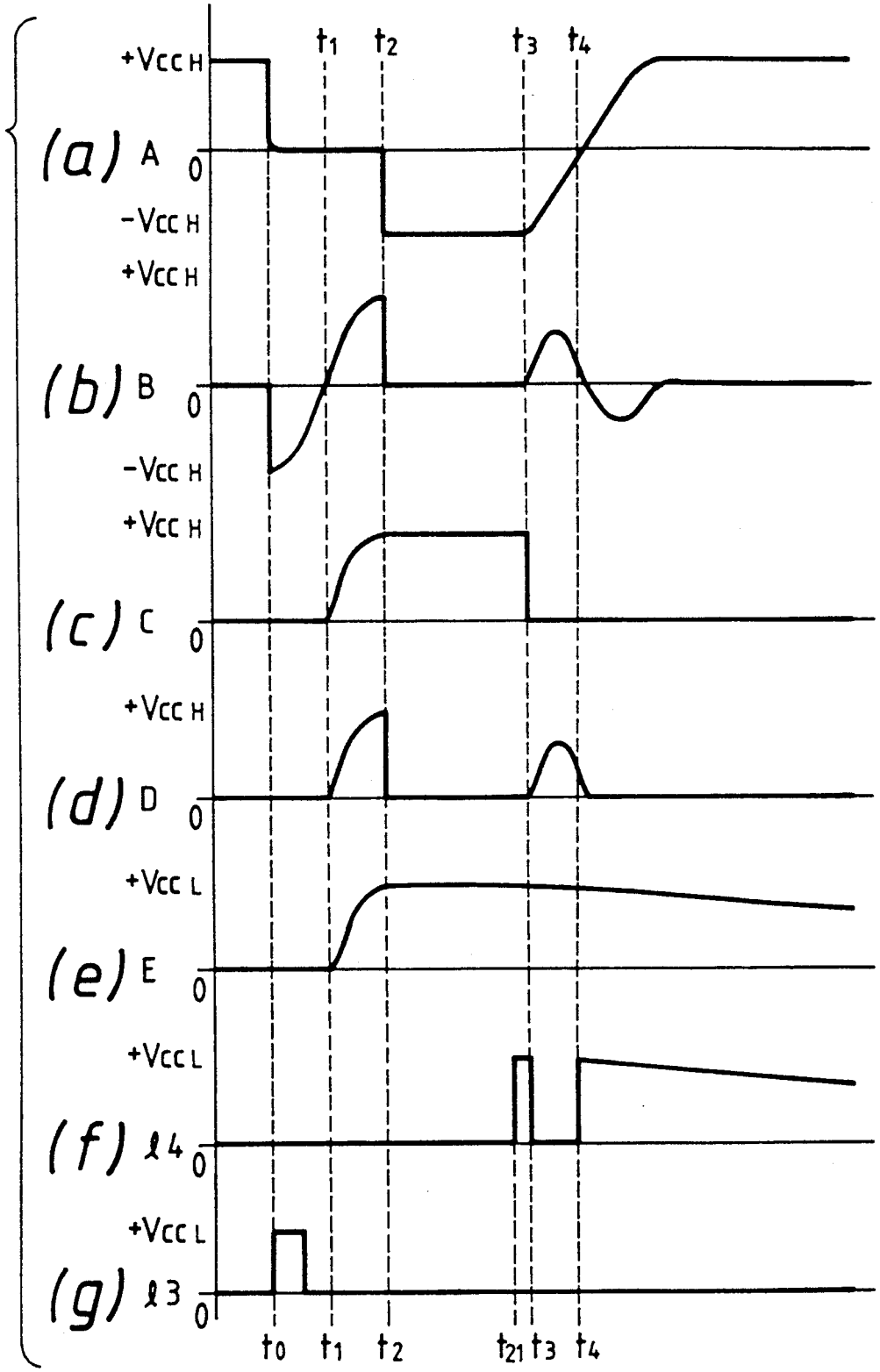

When the flash start switch SW2 is closed in this state, a flash preparation signal is released on the line $l_3$ at a time $t_0$ as shown in FIG. 2(*g*). Said signal is transmitted through the resistor R6 to the gate of the main thyristor SCR1, thereby rendering said main thyristor SCR1 conductive.

By said activation of the main thyristor SCR1, the potential of the anode thereof, or of the junction A, changes from $V_{CCH}$ to zero (approximately ground potential) at $t_0$, as shown in FIG. 2(*a*). Also the activation of the main thyristor SCR1 causes the potential of the junction B, between the capacitor C3 and the coil L2, to assume a change shown in FIG. 2(*b*), in a period from $t_0$ to $t_2$, by an LC resonance oscillation of a closed loop consisting of the capacitor C3, main thyristor SCR1 and coil L2. The anodes of the diodes D3, D4 are connected to said junction B, so that a current is supplied in said diodes D3, D4 only in a period from $t_1$ to $t_2$ in which said potential is positive. Thus the trigger capacitor C2 and the capacitor C4 are respectively charged through said diodes D3 and D4, in a period from $t_1$ to $t_2$, as shown in FIG. 2 (*c*) and (*e*).

Figure 3:
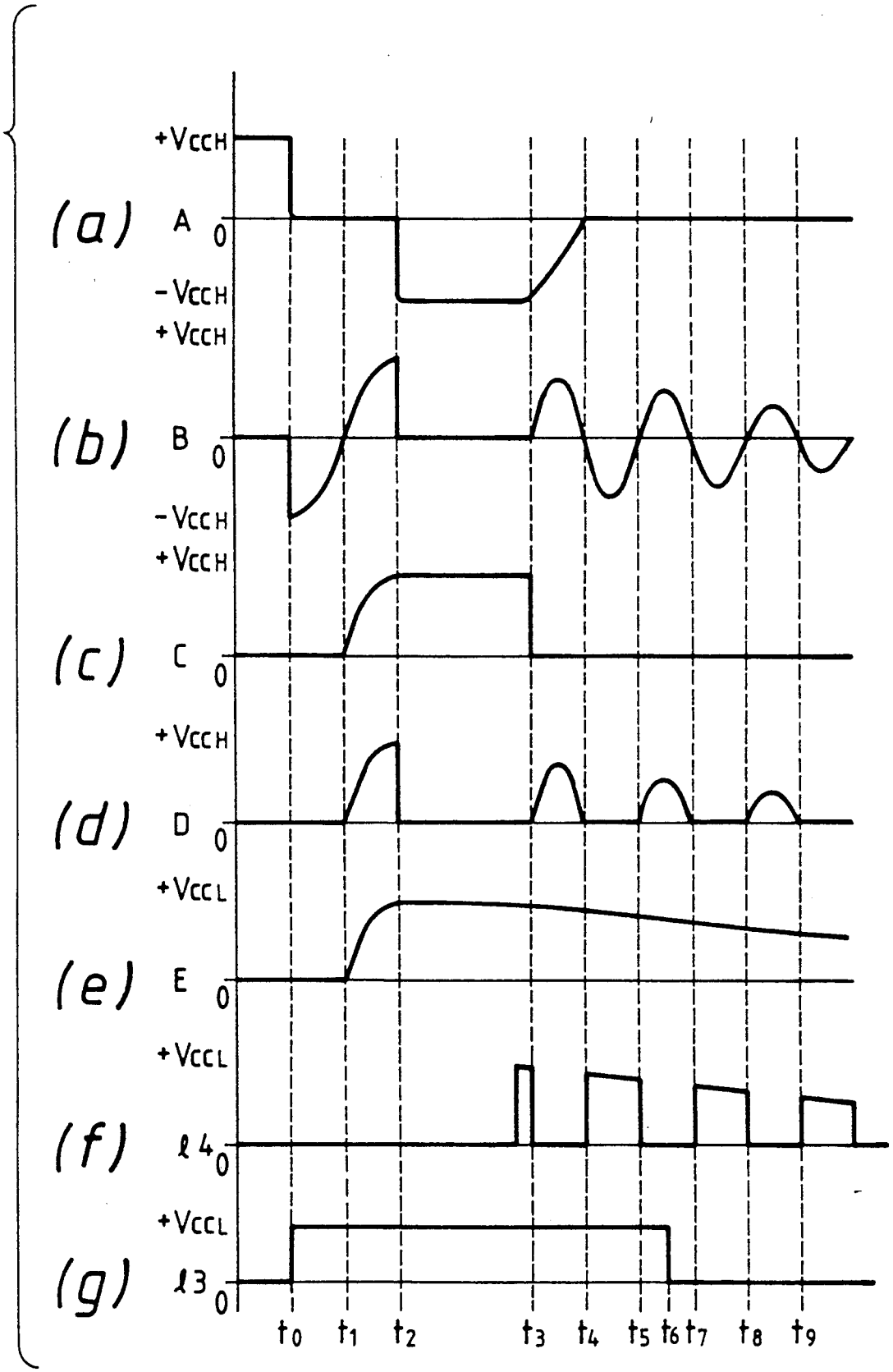

As the flash time control switch SW3 is positioned at "a" as shown in FIG. 1, the duration of the flash preparation signal released on the line $l_3$ is shorter than the period $t_0$–$t_3$ as shown in FIG. 3(*g*).

On the other hand, the capacitor C3 is inversely charged, in a period from $t_0$ to $t_2$, from $-V_{CCH}$ to $+V_{CCH}$ by the potential change at the junction B, resulting from the LC resonance mentioned above. Said inverse charging takes place in a period $T=\pi\sqrt{LC}$ (second), wherein L is the inductance of the coil L2 and C is the capacitance of the capacitor C3.

Thereafter the current tends to flow in the opposite direction by the LC resonance, but said current is blocked by the one-directional main thyristor SCR1, whereby the potential of the junction B changes in uncontinuous manner at $t_2$, as shown in FIG. 2(*b*). Consequently, also the potential of the junction A changes in uncontinuous manner and assumes a value $-V_{CCH}$ at time $t_2$ as shown in FIG. 2(*a*).

When the potential of the junction A becomes negative, the anode and cathode of the main thyristor SCR1 are inversely biased to render the thyristor SCR1 non-conductive.

The flash discharge tube Xe becomes ready for pulse flash emission through the above-explained procedure. The flash emission from the flash discharge tube Xe can be started in this state, by entering a flash start signal through the line $l_4$ to the gate of the trigger thyristor SCR2. Said flash emission is continued until the potential difference across the discharge tube Xe becomes zero, by the charging of the capacitor C3 in the course of said flash emission.

In the following there will be detailedly explained the function when the flash start signal is released through the line $l_4$.

Referring to FIG. 1A, the potential of the junction B is transmitted across the diode D4, only when it is positive, to a junction D4 between said diode D4 and resistor R3, so that the potential of said junction D4 is elected in a period $t_1$–$t_2$ as shown in FIG. 2(*d*). The high voltage at said junction D is converted by the Zenar diode D6 into to a predetermined low voltage, whereby the capacitor C4 is charged in a period $t_1$–$t_2$ through the diode D5, as shown in FIG. 2(*e*). The charge thus accumulated is used for generating the flash start signal to be released on the line $l_4$ as will be described later.

The flash start signal should not be released from the transistor Q at least during the period $t_1$–$t_2$. For this purpose, the base and emitter of the transistor Q is inversely biased by the diode D5 in a period from $t_0$ when the flash preparation signal is released to $t_2$ when the anode of the main thyristor SCR1 assumes a negative potential.

Referring to FIG. 2, the flash start signal on the line $l_4$ is delayed from time $t_2$ though the potential at the junction B is zero, due to the delay in the shift from off-state to on-state of the transistor Q etc.

Subsequently, when the transistor Q is turned on at $t_{21}$, the flash start signal (FIG. 2(*f*)) is transmitted, through the line $l_4$ and the resistor R7, to the gate of the trigger thyristor SCR2 thereby rendering the same conductive. Thus the trigger capacitor C2 is discharged through a closed loop including the trigger thyristor SCR2 and the primary coil of the trigger transformer T, whereby the trigger voltage is applied from the secondary coil of said trigger transformer T to the flash discharge tube Xe, thus inducing flash emission therein.

Since the main thyristor SCR1 is already rendered non-conductive at time $t_2$, the flash current in the flash discharge tube Xe charges the capacitor C3. Thus, upon completion of the charging, the flash emission is terminated as the flow path for the flash current not longer exists. This means that the amount of a single flash emission in consecutive flashes is determined by the capacitance of the capacitor C3.

As explained in the foregoing, the circuit of the present embodiment can repeat flash emissions at a high speed, since the energy required for preparation for the next flash emission, or for LC resonance, is rapidly charged in the capacitor C3 by the flash current, and the trigger capacitor is charged by LC resonance prior to the flash emission.

When the flash discharge tube Xe starts flash emission, the potential of the junction B in FIG. 1 changes in a period $t_3$–$t_4$ as shown in FIG. 2(*b*). With the elevation of potential at the junction B, the base and emitter of the transistor Q are inversely biased to terminate the flash start signal ($t_3$–$t_4$ in FIG. 2(*f*)).

The flash start signal is again released after $t_4$ as shown in FIG. 2(*f*), the flash discharge tube Xe does not emit flash due to the absence of the trigger voltage, since the trigger thyristor SCR2 is rendered conductive in the period from $t_3$ to $t_4$ so that the trigger capacitor C2 is not charged.

A flash emitting operation is completed in the above-explained manner. If the flash number control switch SW4 is positioned at "b", the flash preparation is supplied again to the line $l_4$ after $t_4$, thereby causing a flash emission in the above-explained manner.

In the following there will be explained, with reference to a timing chart shown in FIG. 3, the function in case the flash time control switch SW3 is positioned at "b" for a longer duration of flash emission (a full flash emission from the flash discharge tube Xe).

As in the above-explained pulsed flash emission, the flash preparation signal is supplied to the line $l_3$ in response to the closing of the flash start switch SW2. In contrast to the pulsed flash emission explained above, the flash preparation signal started at $t_0$ continues beyond $t_3$ and is terminated at $t_6$, as shown in FIG. 3(*g*). The operations in a period $t_0$–$t_3$ are identical to those explained before, but the main thyristor SCR1 remains conductive, since the flash preparation signal still continues at $t_3$ when the flash discharge tube Xe starts flash emission. Thus the flash discharge tube Xe provides a full flash emission, as the flash current flows in the conductive state of the main thyristor SCR1. Other detailed functions are same as in the case of pulsed flash emissions and will not, therefore, be explained.

Figure 4:
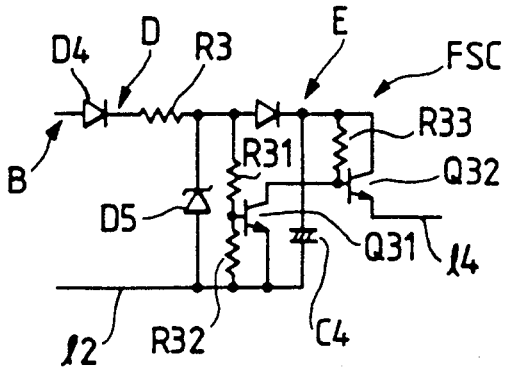
FIG. 4 is a partial circuit diagram of a modified embodiment.

FIG. 4 shows a modified embodiment, in which the PNP transistor of the flash start signal control circuit FSC is replaced by an NPN transistor.

The circuit shown in FIG. 4 is provided with resistors R31, R32, R33 and NPN transistors Q31, Q32, but other components are same as those shown in FIG. 1A. The potential changes at the junctions A–E are same as those shown in FIGS. 2 and 3, and the starting wave form of the flash start signal given to the line $l_4$ is same as explained before.

Figure 5:
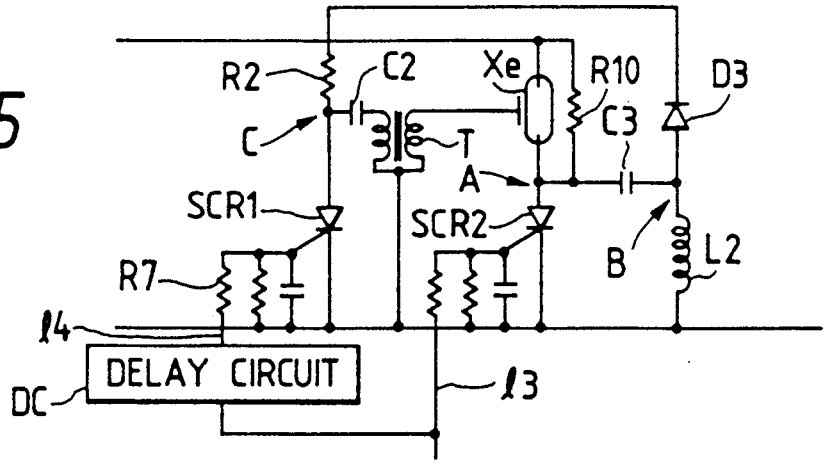

FIG. 5 shows another embodiment, in which the flash start signal control circuit FSC shown in FIG. 1A is dispensed with and replaced by a delay circuit DC for directly receiving the flash preparation signal from the line $l_3$, whereby a flash start signal is released to a line $l_4'$ after the lapse of a time $\pi\sqrt{LC}$ (seconds) (wherein L is the inductance of the coil L1 and C is the capacitance of the capacitor C3) from the start of the flash preparation signal.

Figure 6:
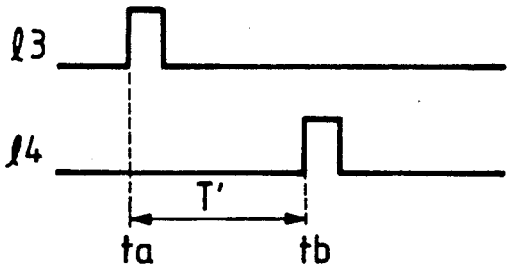
Figure 7:
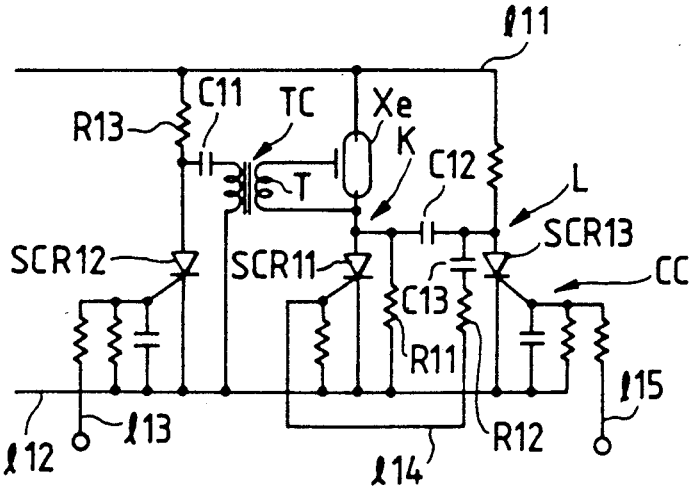
FIG. 7 PRIOR ART
FIG. 7 is a partial circuit diagram of a conventional apparatus.

In response to the start of the flash preparation signal on the line $l_3$, the delay circuit DC initiates a timer operation at the start of said signal (time $t_a$ in FIG. 6), and releases the flash start signal on the line $l_4'$ at a time $t_b$. Said delay circuit DC has to satisfy a relation that the time T' from $t_a$ to $t_b$ is longer than $\pi\sqrt{LC}$. Other functions are same as explained above, and will not therefore be explained further. Said delay circuit DC may be provided in the flash control circuit FCC shown in FIG. 1A.

As explained in the foregoing, an LC resonance circuit is connected to the junction of a flash discharge tube and a serially connected one-directional switching device, wherein said one-directional switching device is at first rendered conductive to activate said LC resonance circuit thereby charging a trigger capacitor, then the one-directional switching device is rendered non-conductive and a trigger circuit is thereafter activated to apply a trigger voltage to the flash discharge tube. Thus the trigger capacitor can be charged by the LC resonance in a preparatory operation prior to the flash emission, and there can be achieved high-speed consecutive flash emissions.

What is claimed is:

1. An electronic flash apparatus comprising:

a flash discharge tube provided between a power supply line and a ground line;

a main capacitor to be charged by a power source for accumulating a charge for causing flash emission from said flash discharge tube;

a trigger circuit comprising at least a trigger capacitor and a trigger transformer and adapted to supply said flash discharge tube with a trigger voltage;

signal generating means for releasing a flash preparation signal at a first timing and releasing a flash start signal at a later second timing;

a first switching device serially connected to said flash discharge tube, rendered conductive by said flash preparation signal to transmit a current only in a direction from the power supply line to the ground line, and rendered non-conductive when inversedly biased after the termination of said flash preparation signal;

a second switch device for activating the function of said trigger circuit in response to said flash start signal;

a flash amount controlling capacitor connected to the junction between said flash discharge tube and said first switching device, adapted to be charged by the flash current and serving to define the amount of flash emission from said flash discharge tube; and a coil so connected as to form a LC resonance circuit together with said flash amount controlling capacitor and as that said LC resonance circuit forms a closed loop in cooperation with said first switching device;

wherein, after said first timing, and during the resonant function of said LC resonance circuit caused by the conductive state of said first switching device in response to said flash preparation signal, said LC resonance circuit is connected to said trigger capacitor thereby charging the same; and said second timing is selected after that the LC resonance circuit starts a resonant function by the conductive state of said first switching device in response to said flash preparation signal, thereby bringing the junction point between said flash discharge tube and the first switching device to a negative potential and inversely biasing said first switching device.

2. An electronic flash apparatus according to claim 1, wherein said signal generating means has a first state in which said flash preparation signal is terminated prior to said second timing and a second state in which said flash preparation signal is continued beyond said second timing.

3. An electronic flash apparatus according to claim 2, wherein said first timing and said second timing are different approximately by a predetermined period, and said signal generating means comprises means for defining said predetermined period.

4. An electronic flash apparatus according to claim 2, wherein said signal generating means is adapted to repeatedly generate said flash preparation signal in said first state.

5. An electronic flash apparatus according to claim 1, wherein said signal generating means comprises a flash control circuit for starting said flash preparation signal from said first timing, and a delay circuit for directly receiving said flash preparation signal from said flash control circuit;

wherein said delay circuit is adapted to generate said flash start signal from said second timing which is after the lapse of a predetermined period from the reception of said flash preparation signal.

* * * * *